United States Patent [19]

Otsuka et al.

[11] 4,295,079

[45] Oct. 13, 1981

[54] LAMP CIRCUIT WITH DISCONNECTED LAMP DETECTING DEVICE

[75] Inventors: Kenichi Otsuka, Kodaira; Yorio Hosokawa, Kawasaki, both of Japan

[73] Assignee: Tokyo Shibaura Denki Kabushiki Kaisha, Kawasaki, Japan

[21] Appl. No.: 133,935

[22] Filed: Mar. 25, 1980

[30] Foreign Application Priority Data

Apr. 19, 1979 [JP] Japan ..... 54/47194

[51] Int. Cl.[3] ..... H05B 37/03

[52] U.S. Cl. ..... 315/130; 315/135; 315/256; 340/642

[58] Field of Search ..... 315/129–131, 315/135, 136, 256; 328/133, 132, 150; 340/642, 658

[56] References Cited

U.S. PATENT DOCUMENTS 3,465,326 9/1969 Weir et al. ..... 340/658 X 3,829,735 8/1974 Berlock et al. ..... 315/131

FOREIGN PATENT DOCUMENTS 52-11023 3/1977 Japan ..... 315/130

*Primary Examiner*—Eugene R. LaRoche

*Attorney, Agent, or Firm*—Oblon, Fisher, Spivak, McClelland & Maier

[57] ABSTRACT

A lamp circuit is provided having a constant current type AC power source and a plurality of isolation transformers connected in series with the AC power source. The secondary circuit of each isolation transformer is connected to an electric lamp. The voltage-time area, which is measured from the rise of the voltage output signal of the power source to the rise of the current output signal of the power source is detected and is compared with a reference predetermined value. Thereby when the detected value exceeds the reference value an alarm signal is generated and the number of the disconnected lamps can be determined and displayed.

14 Claims, 11 Drawing Figures

LAMP CIRCUIT WITH DISCONNECTED LAMP DETECTING DEVICE

BACKGROUND OF THE INVENTION

1. Field of the Invention

This invention generally relates to a lamp circuit in which an AC power source of constant current type, i.e. a constant current regulator (hereinafter designated as CCR), is connected to a plurality of lamps through a plurality of isolation transformers, respectively, and more particularly to a lamp circuit with a disconnected lamp detecting device in which the number of disconnected lamps is detected by means of a change of the voltage-time integral which depends on the magnetic saturation of the isolation transformers in proportion to the number of the disconnected lamps.

2. Description of the Prior Art

A conventional thyristor type CCR, as shown in FIG. 1, has been employed as a power supply for a lamp circuit for use on a landing strip or runway lighting in an airport.

In FIG. 1, numeral 1 designates an AC power source, 2 designates a smoothing reactor, 3 and 4 designates thyristors, 5 designates a power transformers, or output transformer, 6 designates a current transformer, 7 designates a differential amplifier, 8 designates a gate controlling circuit, 9 designates a potential transformer, 10 designates a disconnected lamp detecting circuit, 11 designates an alarm circuit, and 13 designates a reference current input adjuster. Reference numeral 12 designates a series lamp circuit which comprises a plurality of series connected isolation transformers 121, the primary windings of which are connected in series. The secondary winding of each transformer is connected to an electric lamp 122.

As shown in FIG. 1, the output current of the thyristor type CCR is detected by the current transformer 6 and is compared with the signal Cs of the reference current input adjuster 13 in the differential amplifier 7. The differential amplifier 7 amplifies the compared signal and produces a signal Go.

The gate signals $G_1$ and $G_2$ of the gate controlling circuit 8 are supplied to the respective gates of the thyristors 3 and 4 so as to maintain the output current of the CCR at a constant level, i.e. to keep the intensity or brilliance of the lamps at a constant level.

The disconnected lamp detecting circuit 10 is shown in FIG. 2 in detail. After the voltage signal v of the potential transformer 9 and the current signal i of the current transformer 6 are rectified by respective full-wave rectifiers $D_1$ and $D_2$, the difference signal e between the two outputs of the rectifiers $D_1$ and $D_2$ is produced. After smoothing the difference signal e, the smoothed signal is supplied to the base terminal of a transistor Tr which produces a signal A to activate the alarm circuit 11 when the value of the smoothed signal exceeds a predetermined value. The alarm circuit 11 indicates the alarm condition by means of a buzzer or a lamp in response to the alarm signal A.

In the case where no lamp is disconnected, the voltage signal v and the current signal i become respectively waveforms $v_1$ and $i_1$, as shown in FIGS. 3(*a*) and 3(*b*). Therefore, the difference signal e between these signals becomes the waveform $e_1$ shown in FIG. 3(*c*). At this time since the transistor Tr is not turned on, the alarm signal A is not produced.

If it is assumed that a number of the lamps 122 are disconnected, the voltage signal v and the current signal i become respectively the waveforms $v_2$ and $i_2$ shown in FIGS. 3(*d*) and 3(*e*). Therefore, the waveform of the difference signal $e_2$ is shown in FIG. 3(*f*). The smoothed difference signal $e_2$ makes the transistor Tr operate thereby producing the alarming signal.

The detection of the disconnected lamps is thus carried out. However, the waveforms of the voltage signal v and the current signal i are often deformed by disturbances such as noise from the analog signals. Therefore, even though a lamp is not actually disconnected, the voltage value, from which the difference e of the waveform is smoothed, becomes or reaches a value sufficient to operate the transistor Tr of the disconnected lamp detecting circuit 10. As a result, a false alarm signal is produced.

To prevent such an above-mentioned misdetection, the operating voltage value, which makes the transistor Tr operate, must be set to a larger value than the previously set value. Therefore it is impossible to detect a disconnecting lamp with high-sensitivity. Furthermore, the sensitivity of the detection is within the limits of about ten percent of the rated load, and thus the desired sensitivity of detection within a limit of about five percent of the rated load cannot be achieved.

There is the danger of increasing the risks to aircraft due to a defect of the landing or runway lighting in an airport. Moreover, when an isolation transformer, in which the secondary winding has been opened by a disconnected lamp, is left for a long period of time, there is a danger of a winding short upon the application of a high-voltage pulse and the danger of a burn-out due to rising temperature. Furthermore, to display the number of actually disconnected lamps in addition to the alarm function, it is necessary to provide a new display circuit.

SUMMARY OF THE INVENTION

Accordingly, it is one object of this invention to provide a new and improved unique lamp circuit in which the number of disconnected lamps is detected by detecting the magnetic saturation of the isolation transformers which are connected to the disconnected lamps.

Briefly, in accordance with one aspect of this invention, a lamp circuit is provided which includes a constant current type AC power source in series with a plurality of isolation transformers, each having a secondary circuit coupled to an electric lamp. A means for detecting the output current and voltage of the constant current source is provided. The detected output current and voltage are fed to a calculating circuit which produces an output proportional to the number of lamps which are disconnected. The output of the calculating circuit is compared with a predetermined value in a comparator circuit, the output of which controls an alarm indicating that one or more lamps are disconnected.

BRIEF DESCRIPTION OF THE DRAWINGS

A more complete appreciation of the invention will be readily obtained as the same becomes better understood by reference to the following detailed description when considered in connection with the accompanying drawings, wherein.

DETAILED DESCRIPTION OF THE PREFERRED EMBODIMENTS

Figure 1:
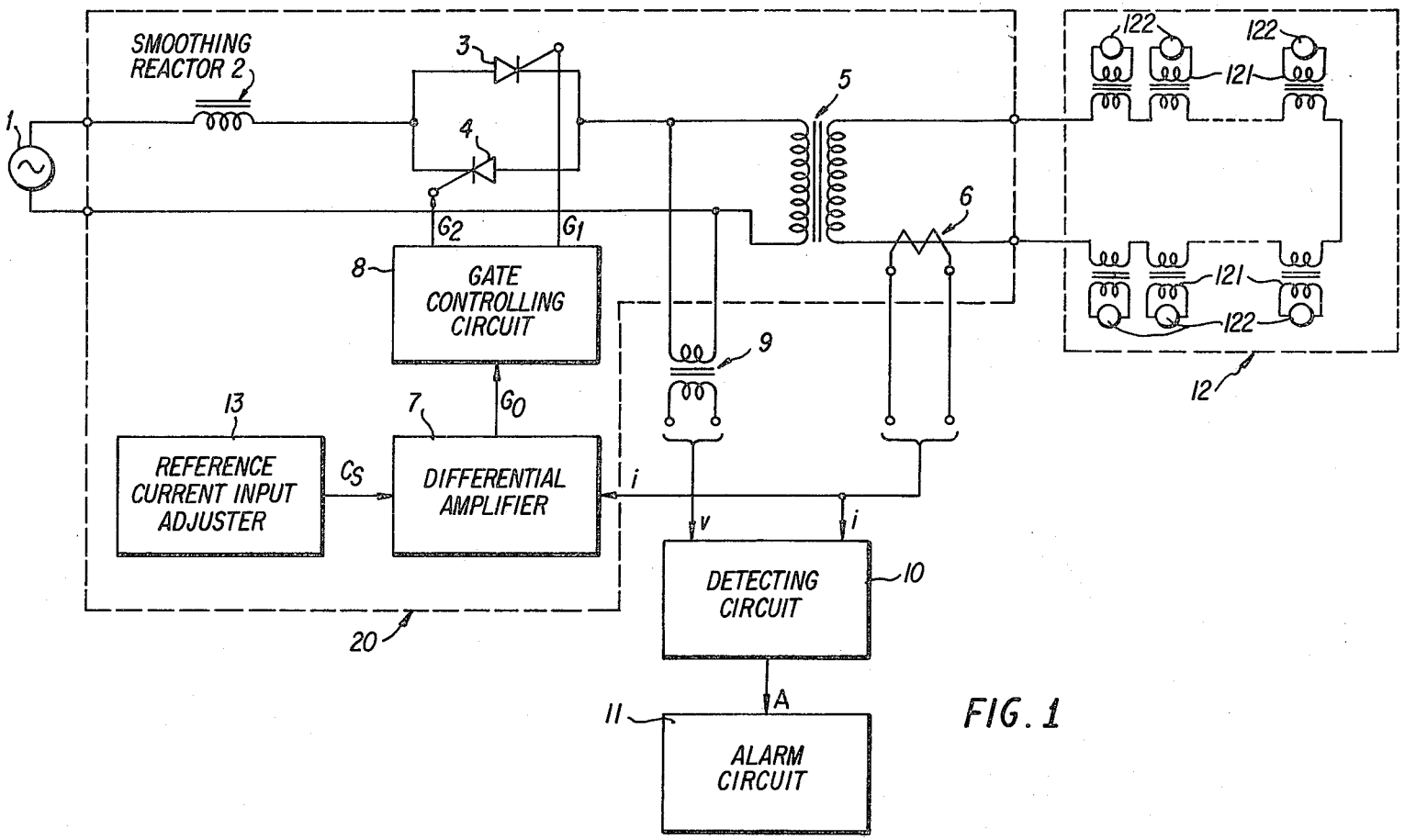
FIG. 1 is a circuit diagram of a conventional lamp circuit.
Figure 2:
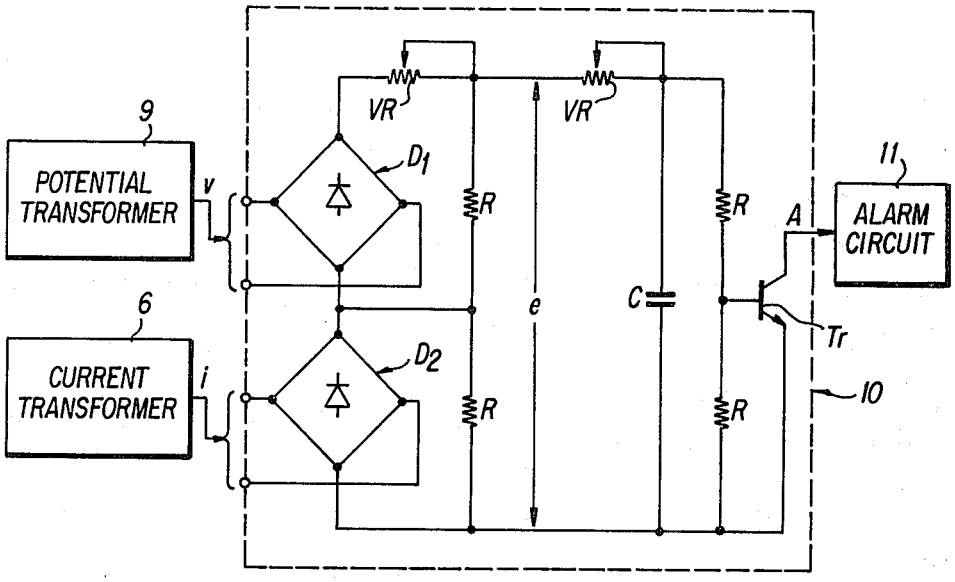
FIG. 2 is a circuit diagram of the detecting circuit shown in FIG. 1.
Figure 3:
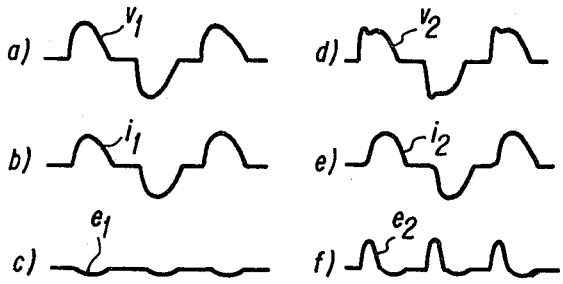
FIGS. 3(*a*) to 3(*f*) are waveforms showing the operation of the detecting circuit shown in FIG. 2.

Referring now to the drawings, wherein like reference numerals and letters designate identical or corresponding parts throughout the several views, and more particularly to FIG. 4 thereof, wherein one preferred embodiment of a lamp circuit in accordance with this invention is shown as including a thyristor type constant current regulating circuit 20 (hereinafter called a thyristor type CCR) provided between an AC power source 1 and a load 12. Load 12 may be, for example, a series lamp circuit including a plurality of series connected isolation transformers 121 which are connected to lamps 122, respectively.

Numeral 21 designates a voltage detecting circuit which produces a voltage signal v having a variable width. Numeral 22 designates a current detecting circuit which produces a current signal i having a variable width. A voltage level detector 23, comnnected to the output of the voltage detecting circuit 21, produces a starting signal which changes from a logic "0" to a logic "1" when the value of the voltage sinal v exceeds a positive predetermined value to which is sufficiently small with respect to the maximum value of the voltage signal v and which is larger than the noise level.

A current level detector 24, connected to the output of the current detecting circuit 22, produces a stopping signal is which changes from a logic "0" to a logic "1" when the value of the current signal i exceeds a positive predetermined value io which is sufficiently small with respect to the maximum value of the current signal i and which is larger than the noise level. A flip-flop 25, connected to the starting signal vs and the stopping signal is, is set by the starting signal vs (consequently the output Q becomes a logic "1") and is reset by the stopping signal is (consequently the output Q becomes a logic "0").

A diode 26, connected to the voltage detecting circuit 21, half-wave rectifies the voltage signal v to produce a voltage signal vp. A potentiometer 27 connected to the diode 26 sets a voltage signal vp' by dividing the voltage signal vp.

A voltage frequency converter circuit 28 oscillates at a frequency proportional to the positive voltage value vp ' and generates a pulse train Cp. A gate circuit 29 passes the pulse train Cp only when the output Q of the flip-flop 25 is at a logic "1", whereby the pulse train Ck is generated.

A counter circuit 30 counts the pulse train Ck and transmits, as a result, a digital count SD. The counter 30 is cleared or reset to zero when the starting signal vs becomes a logic "1".

A disconnected lamp quantity input adjuster circuit 31 is used to set the number of disconnected lamps MD to be alarmed. A digital comparator circuit 32 compares the output digital value SD of the counter circuit 30 with the set number MD of the input adjuster circuit 31 and produces an alarm signal AS when the value SD exceeds the set number MD.

The alarm circuit 33, details of which are not shown, comprises a flip-flop set by the alarm signal As and reset by a manual resetting switch, an alarm buzzer, an alarm lamp, and a switching circuit which operates the alarm circuit.

The operation of the lamp circuit shown in FIG. 4 will be explained with reference to the time chart of FIG. 5.

In the thyristor type CRR, the firing phase of the thyristors 3 and 4 is controlled so as to supply electric power with a constant current set by the reference current input adjuster 13 shown in FIG. 1. Therefore, in the case where there are not disconnected lamps in the series lamp circuit, the waveforms of the voltage signal v and current signal i with reference to an input voltage signal V of the power source 1 are as shown in FIG. 5.

If it is assumed that a certain lamp is disconnected, since the secondary winding of the isolation transformer 121, which is connected to the disconnected lamp, is opened a magnetic saturation phenomenon is created.

Figure 5:
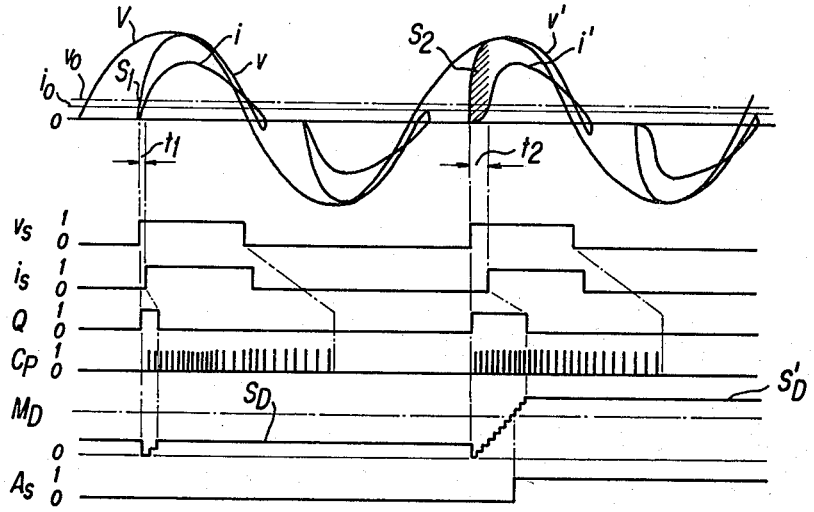
FIG. 5 is a time chart showing the operation of the lamp circuit shown in FIG. 4.
Figure 6:
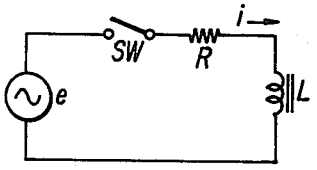
FIG. 6 is an equivalent circuit of the series lamp circuit shown in FIG. 1.

Accordingly, the rise of the output current of the thyristor type CCR 20 is slowly delayed until the isolation transformer 121 becomes magnetically saturated and then rapidly rises, as shown by the waveform i' in FIG. 5. Moreover, the waveform v' of the voltage signal rapidly rises during the slow rise of the current signal i'. Thus, the area of the waveform of the voltage signal until the current signal rapidly rises is changed from the area $S_1$ in the case of no disconnected lamp to the area $S_2$ as shown in FIG. 5. This area of the waveform is obtained from an equivalent circuit comprising an inductance L having an iron core to be magnetically saturated and a resistance R as shown in FIG. 6. If it is assumed that the number of turns in a coil having the inductance L is N, an equation 1 is obtained in the circuit of FIG. 6, as follows:

$$Ri+N\,d\phi/dt=e \qquad (1)$$

where e: voltage of the power source
$\phi$: flux
t: time

If the value Ri is ignored, a flux changing quantity $\Delta\phi$ during a minor time from zero to time t is obtained as follows:

$$\Delta\phi = \frac{1}{N}\int_{o}^{t} e\,dt \qquad (2)$$

Therefore, the current i in FIG. 6 rapidly or suddenly flows into the resistance R when the voltage e of the power source exceeds the saturation voltage of the coil.

If it is assumed that at time t=to a saturated flux is $\phi_S$, since the flux is changed from a value $-\phi_S$ at the end of the previous half cycle to a value $+\phi_S$, the flux changing quantity $\Delta\phi$ is obtained from the following equation 3:

$$\Delta\phi = \frac{1}{N}\int_{o}^{to} e\,dt = 2\phi_s \quad (3)$$

If the equation (3) is now rearranged by a constant of the coil per se having an iron core and it is further assumed that the rearranged component is represented by So, the equation becomes as follows:

$$So = \int_{o}^{to} e \cdot dt = 2\phi_s N \quad (4)$$

Namely, it should be readily apparent that the voltage-time integral until the iron core of the coil is saturated becomes a constant. Accordingly, an equation indicating the relationship between the number of coils n, i.e. number of isolation transformers 121, having disconnected lamps and the voltage-time integral S required for magnetic-saturation is obtained as follows:

$$S=2\phi_s \cdot N \cdot n \quad (5)$$

Thus, since the voltage-time integral S is changed in proportion to the number of disconnected lamps, the voltage-time integral from the time that the voltage signal v becomes equal to the set voltage value vo until the time that the current signal i becomes equal to the set current value io is changed from the area $S_1$ to the area $S_2$ as shown in FIG. 5.

Accordingly it is possible to detect the quantity of the disconnected lamps by measuring the voltage-time area $S_2$ and then comparing the measured signal with a reference area signal.

Figure 4:
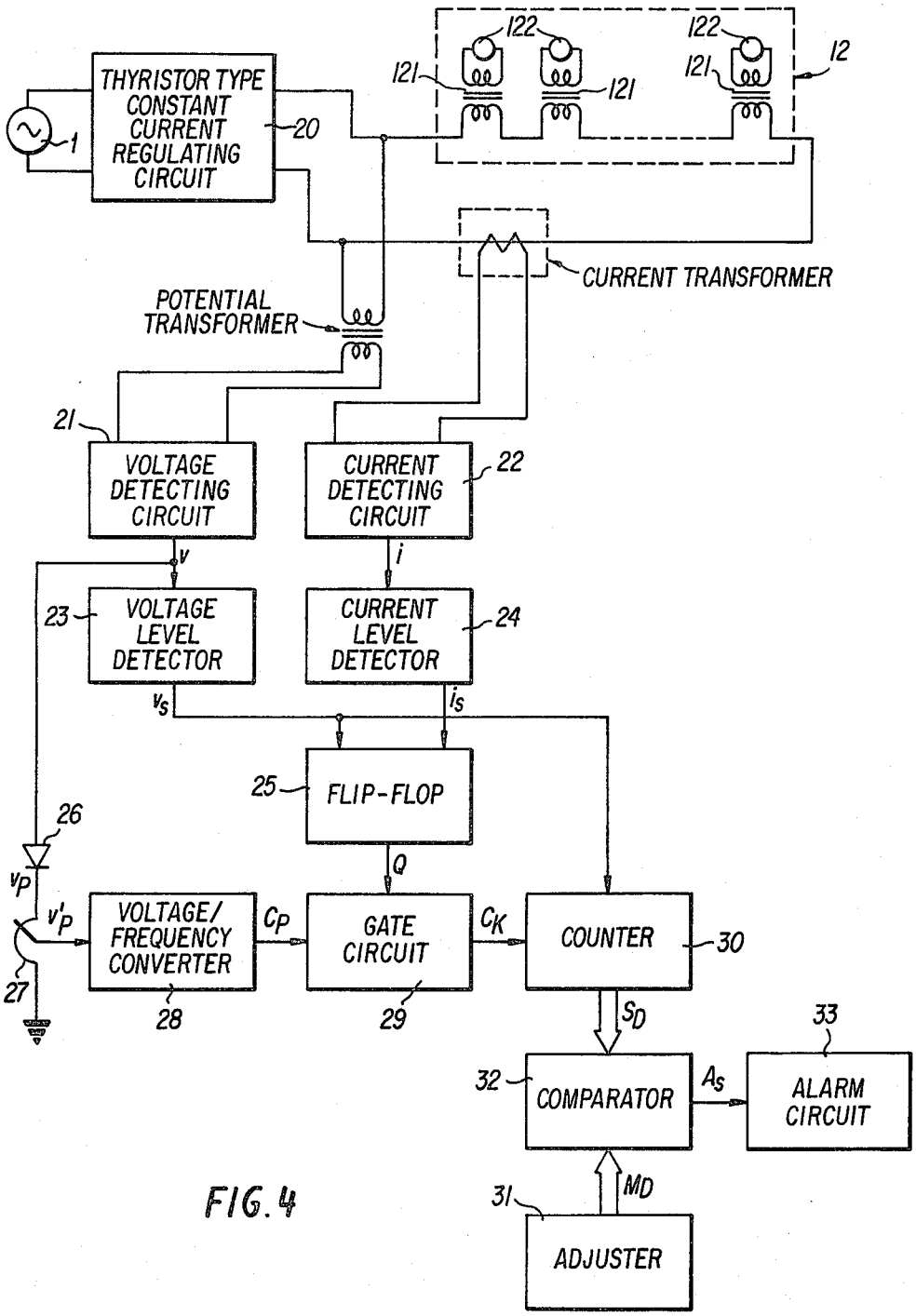
FIG. 4 is a circuit diagram of one of the preferred embodiments of the present invention.

Furthermore, each signal in FIG. 4 is explained with reference to the time chart of FIG. 5 in both the case where there is no disconnected lamp and the case where at least one lamp is disconnected. The voltage signals v and v' are converted to the starting signal vs having a logic level "1" when the voltage signals v and v' exceed the set value vo. The current signals i and i' are converted to a stopping signal is having a logic level "1" when the current signals i and i' exceed the set value io.

The output Q of the flip-flop 25 becomes a logic "1" when the starting signal vs becomes a logic "1", and becomes a logic "0" when the stopping signal is becomes a logic "1". Furthermore the pulse train Ck is made up of the number of pulses Cp which are passed through the gate circuit 29 when the output Q of the flip-flop 25 is at a logic "1". In addition the pulse train Cp shown in FIG. 5 is illustrated on an enlarged time scale.

The digital counting values SD and SD' are outputs of the counter 30 which counts the number of pulses of the pulse train Ck. These digital counting values are cleared to zero when the starting signal vs becomes a logic "1".

Moreover, the digital value MD is an output of the adjuster 31 which is set as an analog value or a digital value as a disconnected lamp alarm quantity. The digital value MD is kept at a constant value unless the set value of the adjuster 31 is changed. These digital counting values SD or SD' are compared with the digital set value MD in the digital comparator circuit 32. When the digital counting value SD' is larger than the digital set value MD, the alarm signal As is generated to the alarm circuit 33. Accordingly, the alarm circuit 33 causes the alarm buzzer or lamp to operate to indicate that the number of the disconnected lamps exceeds the permitted quantity.

By the above-described simple circuit shown in FIG. 4, it is possible to easily and rapidly detect the number of disconnected lamps with increased sensitivity.

Thus, although the invention has been explained by way of example using a thyristor type constant current regulator (CCR) as a current controlling device for the electric power source, the invention is not limited to this type of regulator. It should be apparent that since the voltage to be applied to the series lamp circuit 12 is of a sine wave type, this invention is applicable to a RC type CCR with an LC resonance circuit as shown in FIG. 9.

Figure 9:
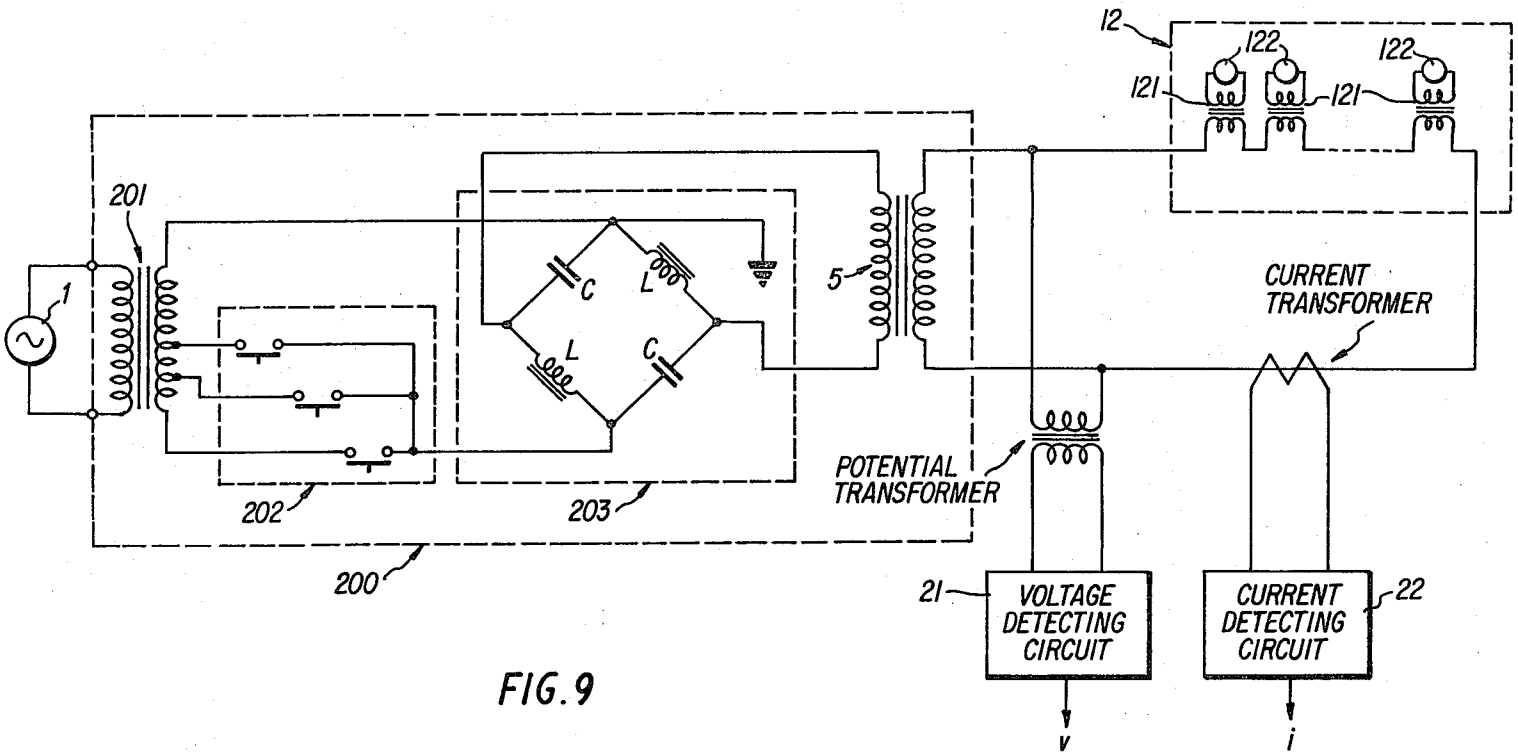
FIG. 9 is a circuit diagram of a lamp circuit of another embodiment of the present invention which uses an RC type constant current regulator as a power supply.

Referring now to FIG. 9, numeral 201 represents an input transformer, 202 an intensity or brilliance selector circuit, and 203 a resonance circuit comprisng a reactor L and a capacitance C. The other reference numerals and letters designate identical or corresponding parts as in FIGS. 1 and 4. In this RC type CCR 200 if the values of the reactor L and the capacitance C are determined such that $\omega L=1/\omega C$, where $\omega$ represents the angular frequency of the power source, the current flowing through the series lamp circuit of the load becomes a constant regardless of the load quantity.

Thus the RC type CCR 200 is a relatively simple and economical circuit which has at present mainly been employed in airports. It should be readily apparent from the timechart shown in FIG. 10 that by supplying the voltage signal v of the voltage detecting circuit 21 and the current signal i of the current detecting circuit 22 to the respective inputs of the voltage level detecting circuit 23 and diode 26 and to the input of the current level detecting circuit 24 shown in FIG. 4, this invention will be carried out. Namely, the voltage signal v and the current signal i become constant sine waves, v and i, selected by the intensity or brilliance selector 202. The current signal i becomes slightly delayed in phase with respect to the voltage signal v due to the impedance of the series lamp circuit 12. But if a lamp is disconnected in the series lamp circuit 12, the isolation transformer 121 which is connected to the disconnected lamp produces the magnetic saturation phenomenon. The rise of the current of the RC type CCR is delayed until the isolation transformer 121 becomes magnetically saturated. As a result, the current signal i is changed to the deformed current waveform i' as compared to a sine wave. At that time, the voltage-time integral from the application of the voltage until the time when the current suddenly rises, as indicated in the equation (4), is determined by a constant of the isolation transformer 121 and then becomes a constant.

Figure 10:
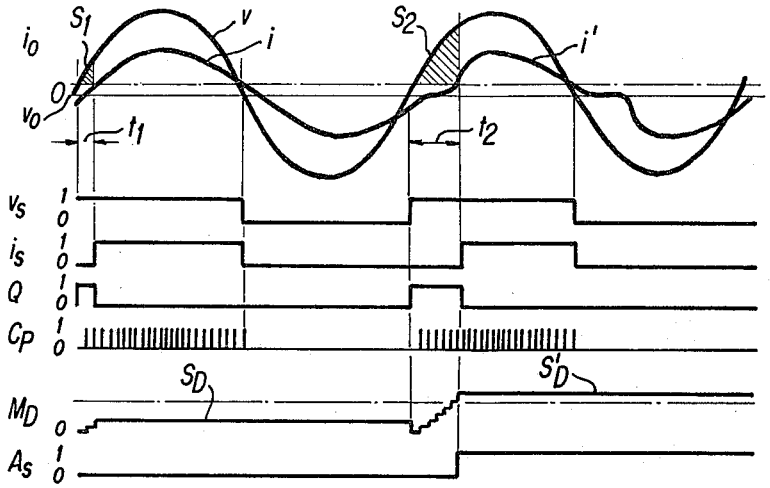
FIG. 10 is a time chart showing the operation of the lamp circuit shown in FIG. 9.

Accordingly the equation (5) comes into existence and the voltage-time integral is changed from the area $S_1$ to the area $S_2$ as shown in FIG. 10, in accordance with the change from the time when the voltage signal v becomes equal to the predetermined voltage value vo to the time when the current signal i becomes equal to the predetermined current value io.

Therefore the voltage-time area $S_2$ is measured and its measured quantity is compared with a reference voltage-time area. As a result, it is possible to detect the number of the disconnected lamps as well as in the case of the thyristor type CCR.

Figure 7:
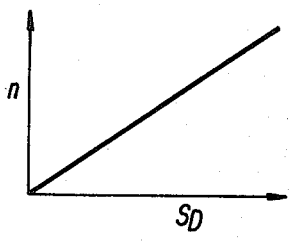
FIG. 7 is a graph showing a relationship between the integrated output value SD of a counter and the number of disconnected lamps n in the circuit shown in FIG. 4.

Furthermore, since the voltage-time integral S, as indicated in the equation (5), is proportional to the number n of the disconnected lamps, the relationship is shown in FIG. 7. By constructing the circuit shown in the block diagram of FIG. 8, it is therefore possible to display the number n of the disconnected lamps.

Figure 8:
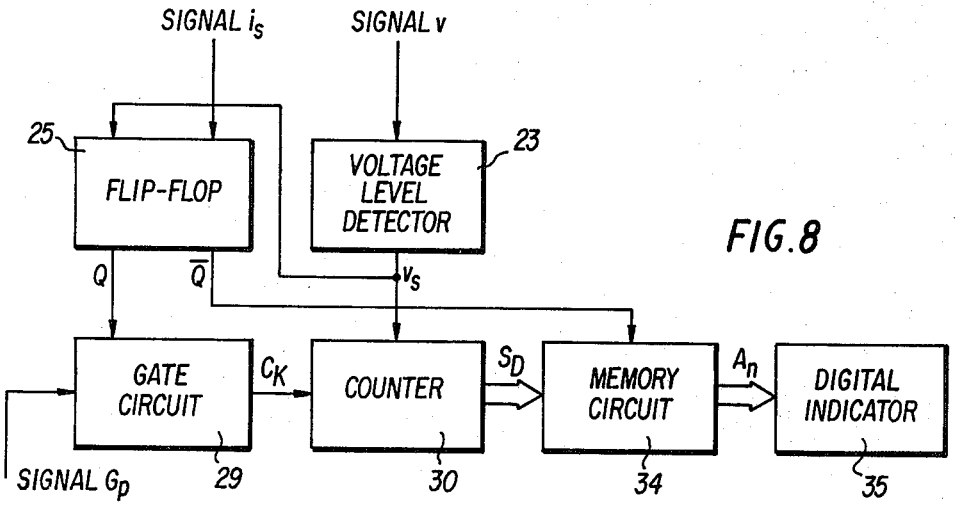
FIG. 8 is a circuit diagram of a digital display circuit for displaying the number of disconnected lamps of another embodiment of the present invention.

Referring now to FIG. 8, the numeral 34 represents a memory circuit in which a digital input value is divided by certain value to produce the divided digital output An. The divided digital output An is latched by a latching function. A digital indicator or display circuit 35 causes a light emitting diode device to turn on in response to the digital output An of the memory circuit 34.

In such a construction as shown in FIG. 8, the digital counting value SD in the counter circuit 30, which counts the number of pulses of the pulse train Ck from the gate circuit 29, is latched in the memory 34 when the inverse output $\overline{Q}$ of the flip-flop 25 becomes a logic "1", i.e. when the counting in the counter circuit 30 is finished. The latched signal in the memory 34 is divided by a certain value and its divided digital value is supplied to the digital indicator 35 as the display signal An. As a result a light emitting diode display, which corresponds to the display signal An, is lighted and thereby the number of disconnected lamps is displayed as a digital number.

Thus, since the number of the disconnected lamps present can always be displayed, it is possible to plan the replacement of the disconnected lamps in advance.

Figure 11:
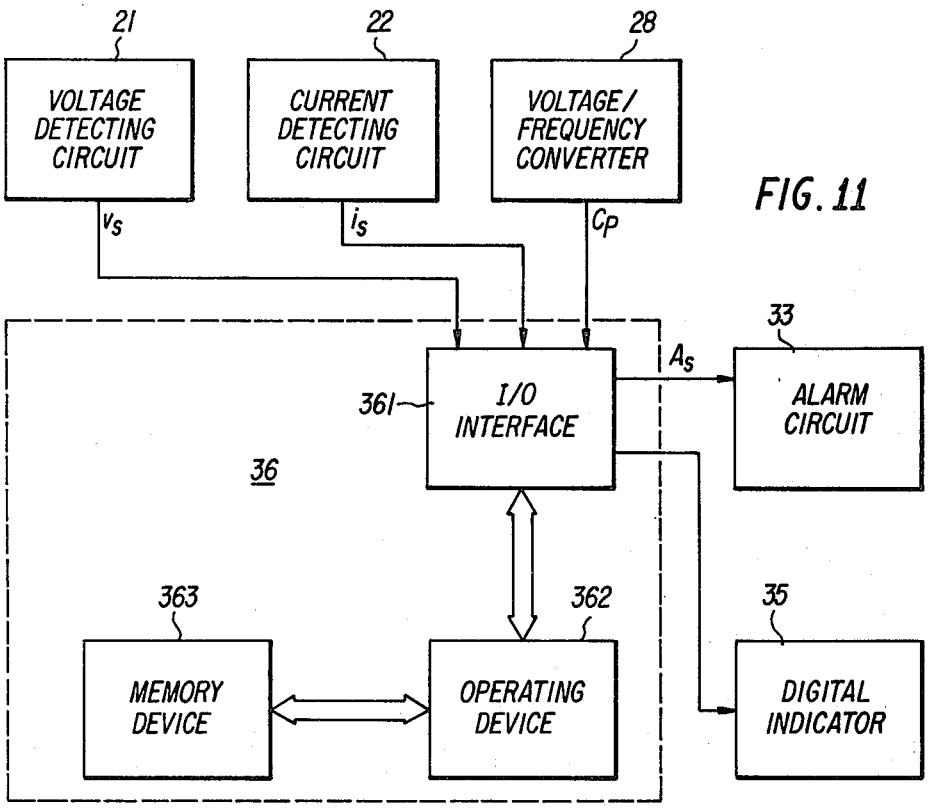
FIG. 11 is a block diagram of still another embodiment of the present invention.

An alternative and preferred embodiment of a lamp circuit according to this invention is shown with reference to FIG. 11, wherein a part of the circuits shown in FIGS. 4 and 8 is replaced by a microprocessor unit 36. That is to say, the starting signal vs, the stopping signal is, and the pulse train Cp are supplied to an I/O interface device 361. An operating device 362 counts the number of pulses in the pulse train Cp beginning when the starting signal vs becomes a logic "1" and stops counting when the stopping signal is becomes a logic "1".

The counted value SD in the operating device 362 is compared with a digital predetermined value MD representing a permitted quantity of disconnected lamps which is memoried or stored in a memory addressed in the memory device 363. When the counted value SD exceeds the predetermined value MD, the alarm signal AS is supplied from the I/O interface device 361 to the alarm circuit 33.

Of course, after digital predetermined values $M_1$, $M_2$, . . . $M_n$ corresponding to the number of disconnected lamps are memoried or stored in the memory of the memory device 363, the counted value SD in the operating device 362 is compared with these digital predetermined values $M_1$, $M_2$, . . . $M_n$. Thereby it is possible to supply the compared signal An corresponding to the number of disconnected lamps to a digital indicator or display circuit 35, which displays the number of disconnected lamps, through the I/O interface device 361.

Moreover, although this invention has been explained by way of example using the voltage detecting circuit 21, the voltage level detector 23, the current detecting circuit 22, and the current level detector 24 as individual circuits, respectively, it should be apparent that, if desired, a voltage detecting circuit and a current detecting circuit could be utilized combining these functions.

Furthermore, although this invention has been explained by way of examples indicating that the counting of a number of pulses in the pulse train Ck by the counter circuit 30 is done once during each cycle of the AC power source, it is also possible to count the number of pulses in the pulse train Ck once during each half cycle by setting ± vo as the voltage predetermined values in the voltage level detector 23 and ± io as the current predetermined values in the current level detector 24. Moreover, by comparing an averaged value of the digital counted value SD during a few cycles with the digital predetermined value MD of the adjuster circuit 31 representing the disconnected quantity, it is also possible to prevent misoperation due to noise, etc.

In addition, instead of the starting signal vs from the voltage level detector circuit 23, by supplying the gate signals $G_1$ and $G_2$ which are output signals of the gate controlling circuit 8 of the thyristor type CCR as shown in FIG. 1 to the flip-flop circuit 25 in the counter circuit 30 in FIG. 4 or to the I/O interface 361 in FIG. 11, it should be apparent that, if desired, the voltage detecting circuit 21 and the voltage level detector circuit 23 could be omitted.

It should now be apparent in accordance with the teachings of the present invention that the rise of the current waveform of the CCR is delayed until the isolation transformer having the disconnected lamp is magnetically saturated due to the disconnected lamp, that the voltage-time area from the rise of the voltage signal to the rise of the current signal is proportional to the number of the disconnected lamps, and that the number of pulses of a pulse train having a frequency corresponding to the voltage of the load is counted whereby an alarm signal indicating that lamps are disconnected is generated and/or a display of the number of the disconnected lamps is carried out.

It is possible to detect with high accuracy the disconnected quantity of lamps in accordance with this invention because the counted value is not affected by the voltage waveforms, the changing of the AC power source voltage, and the predetermined current set value, etc.

Moreover, according to this invention, since the circuit construction is simple and is realized inexpensively, it is possible to apply this invention to the RC type CCR circuit. Furthermore, according to this invention, it is possible to prevent a winding short due to an opening of the secondary circuit of the isolation transformer having a disconnected lamp, an excessive output power drain due to temperature rise in a shorted transformer, and a subsequent burn-out of the isolation transformer.

According to this invention, since the number of the disconnected lamps in the series lamp circuit can be easily displayed, it is possible to plan or schedule the replacement of the disconnected lamps from the state of the display in advance, and thus the efficiency of the maintenance work in the airport can be improved.

Furthermore, this invention is not limited to installation in airports as it is also possible to apply the invention to all series lamp circuits using isolation transformers.

Obviously, many modifications and variations of this invention are possible in light of the teachings of this invention. It is therefore to be understood that within the scope of the appended claims, the invention may be practiced otherwise than as specifically described herein.

What is claimed as new and desired to be secured by Letters Patent of the United States is:

1. A lamp circuit comprising:

a constant-current type AC power source;

a plurality of isolation transformers connected in series with the AC power source, each isolation transformer being coupled to an electric lamp;

means for detecting the rise of the output voltage waveform of the AC power source which exceeds a positive predetermined value which is sufficiently small with respect to the maximum level of the voltage signal and which is larger than a possible circuit induced noise level;

means for detecting the rise of the output current waveform of the AC power source which exceeds a positive predetermined value which is sufficiently small with respect to the maximum value of the current signal and which is larger than a possible circuit induced noise level;

means for performing a calculation utilizing as an input the output of said voltage detecting means and the output of said current detecting means;

means for comparing the output of said calculating means with a predetermined calculated value;

whereby the failure of at least one of said electric lamps coupled to said plurality of isolation transformers is detected.

2. A lamp circuit as recited in claim 1, wherein:

the constant-current type AC power source is a resistance-capacitance type AC power source including an L-C resonance circuit.

3. A lamp circuit as recited in claim 1, wherein:

the calculating means is an integrating circuit which integrates over time a certain electric quantity from the beginning of the rise of the output voltage waveform of AC power source to the beginning of the rise of the output current waveform of AC power source.

4. A lamp circuit as recited in claim 3, wherein:

the certain electric quantity is the value of the voltage of the AC power source as detected by the voltage detecting means.

5. A lamp circuit as recited in claim 1, wherein the calculating means comprises:

a counter means for counting a pulse signal whose frequency is proportional to a certain electric quantity in response to the output signal of the voltage detecting means and for stopping the counting in response to the output signal of the current detecting means.

6. A lamp circuit as recited in claim 5, wherein:

the pulse signal proportional to the certain electric quantity is produced by a voltage to frequency converter means which is coupled to the voltage detecting means.

7. A lamp circuit as recited in claim 5, wherein the calculating means further comprises:

flip-flop circuit means connected to the output of the voltage detecting means and to the output of the current detecting means; and gate circuit means for passing the pulse signal proportional to the certain electric quantity to the input of the counter means under control of said flip-flop means.

8. A lamp circuit as recited in claim 5, wherein the calculating means further comprises:

memory circuit means coupled to the output of the counter means for storing the output of the counter means; and means for indicating the output of the memory circuit means.

9. A lamp circuit as recited in claim 1, which further comprises:

alarm means for producing an alarm in response to the output of the comparing means.

10. A lamp circuit as recited in claim 1, which further comprises:

means for indicating the output of the comparing means.

11. A lamp circuit as recited in claim 1, which further comprises:

means for producing an alarm in response to the output of the comparing means; and means for indicating the output of the comparing means.

12. A lamp circuit as recited in claim 11, wherein the calculating means comprises an electronic digital computing means which includes:

an input-output interface circuit coupled to the voltage detecting means, the current detecting means, the alarm means, and the means for indicating the output of the comparing means;

means coupled to said input-output interface circuit for processing the outputs of the voltage detecting means and the current detecting means; and means for memorizing the output of the processing means.

13. A lamp circuit comprising:

a constant-current type AC power source;

a plurality of isolation transformers connected in series with said AC power source, each isolation transformer being coupled to an electric lamp;

means for measuring a delay in the rise time of the output current waveform of said AC power source which delay corresponds to the magnetic saturation of at least one of said plurality of isolation transformers;

whereby the failure of at least one of said electric lamps coupled to said plurality of isolation transformers is detected.

14. A lamp circuit as recited in claim 13, which further comprises:

means for comparing the output of the measuring means with a predetermined value;

means for producing an alarm when the comparing means produces an output signal; and means for indicating the output of the measuring means.

* * * * *